US009255759B1

(12) United States Patent
Archer

(10) Patent No.: US 9,255,759 B1
(45) Date of Patent: Feb. 9, 2016

(54) COMPOUND BOW DRAW WEIGHT ADJUSTER OPERABLE AT FULL DRAW AND LOFT ADJUSTING RELEASE AND TROLLEY ARM

(71) Applicant: Gene R. Archer, Newark, OH (US)

(72) Inventor: Gene R. Archer, Newark, OH (US)

( * ) Notice: Subject to any disclaimer, the term of this patent is extended or adjusted under 35 U.S.C. 154(b) by 0 days.

(21) Appl. No.: 14/706,374

(22) Filed: May 7, 2015

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/1449* (2013.01)

(58) Field of Classification Search
CPC ..... F41B 5/10; F41B 5/1403; F41B 5/1449; F41B 5/105
See application file for complete search history.

(56) References Cited

U.S. PATENT DOCUMENTS 3,486,495 A 12/1969 Allen
4,054,118 A * 10/1977 McKee ..... F41B 5/105 124/25.6
4,076,005 A * 2/1978 Hill ..... F41B 5/10 124/25.6
4,078,537 A * 3/1978 Carella ..... F41B 5/0094 124/25.6
4,187,826 A * 2/1980 Killian ..... F41B 5/0026 124/25.6
4,201,182 A * 5/1980 Butler ..... F41B 5/10 124/25.6
4,667,649 A * 5/1987 Humphrey ..... F41B 5/10 124/25.6
4,781,168 A * 11/1988 Lester ..... F41B 5/0094 124/25.6
4,955,354 A * 9/1990 Bozek ..... F41B 5/10 124/23.1
4,971,020 A * 11/1990 Soderstrom ..... F41B 5/10 124/23.1
5,388,564 A * 2/1995 Islas ..... F41B 5/0094 124/23.1
9,091,503 B2 * 7/2015 Howard ..... F41B 5/10

* cited by examiner

*Primary Examiner* — Melba Bumgarner
*Assistant Examiner* — Amir Klayman
(74) *Attorney, Agent, or Firm* — Frank H. Foster; Kremblas & Foster

(57) ABSTRACT

A compound bow draw weight adjuster permitting the draw weight to be adjusted with the bowstring at full draw. A toggle arm is pivotally mounted to the bow's riser. A limb deflector is positioned on the riser at the loading end segment of each limb. Each limb deflector has a cam cap spaced from the loading end segment of the limb, a cam interposed between the cam cap and the loading end segment, a fastener extending through the cam cap and through the loading end segment of the limb and anchored in the riser and a cam extension lever fixed to the cam for rotating the cam. A first cam link is connected between the toggle arm and a first one of the cam extension levers for rotating its cam. A second cam link is connected between the toggle arm and a second one of the cam extension levers for rotating its cam.

18 Claims, 7 Drawing Sheets

Fig. 1
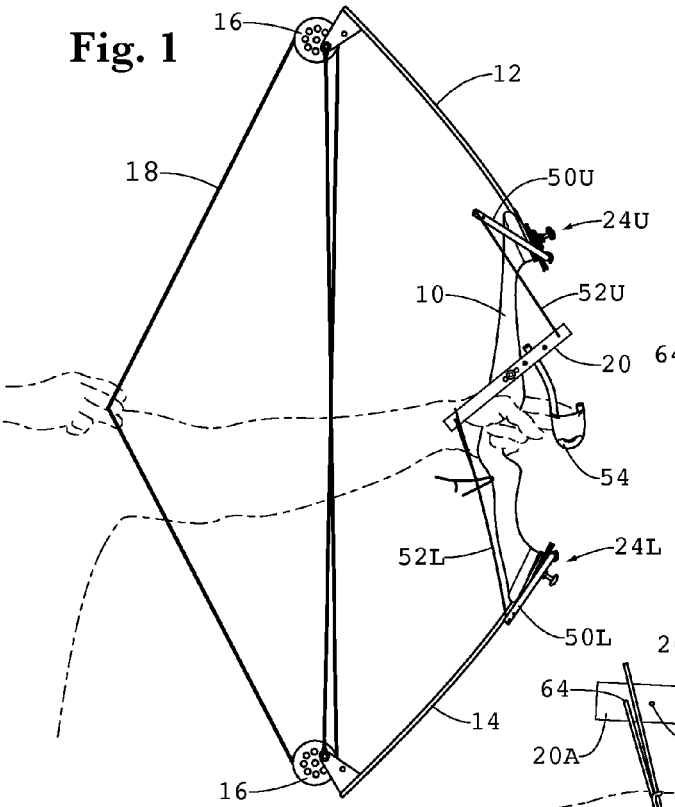
Fig. 3
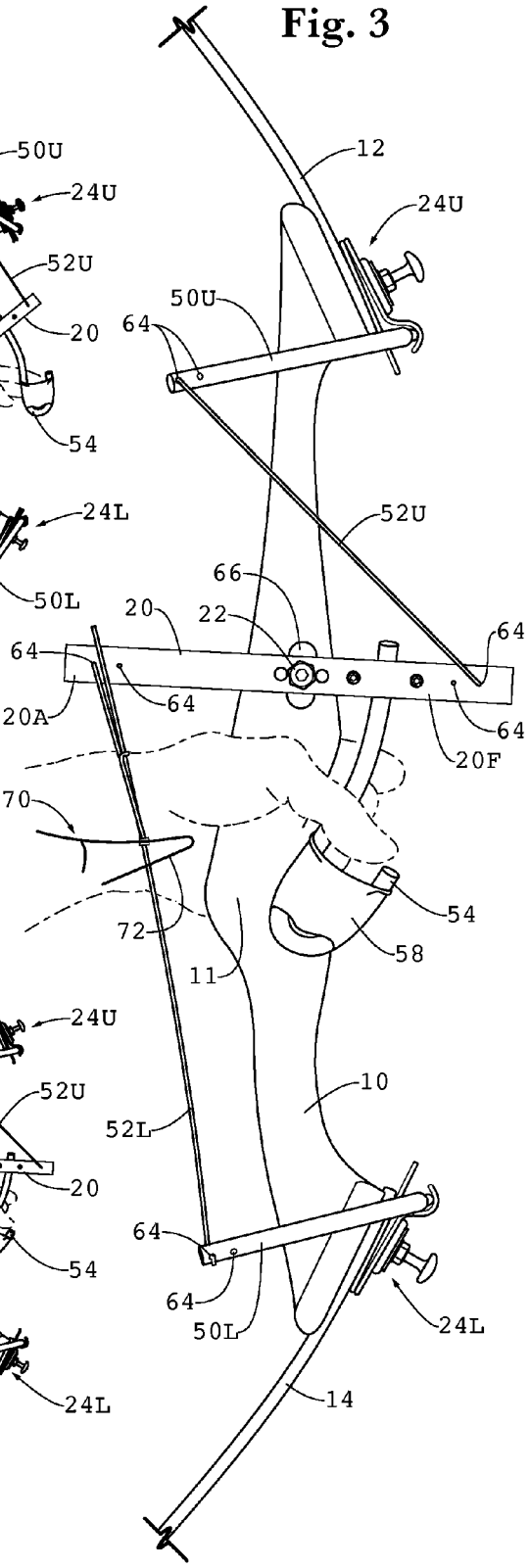
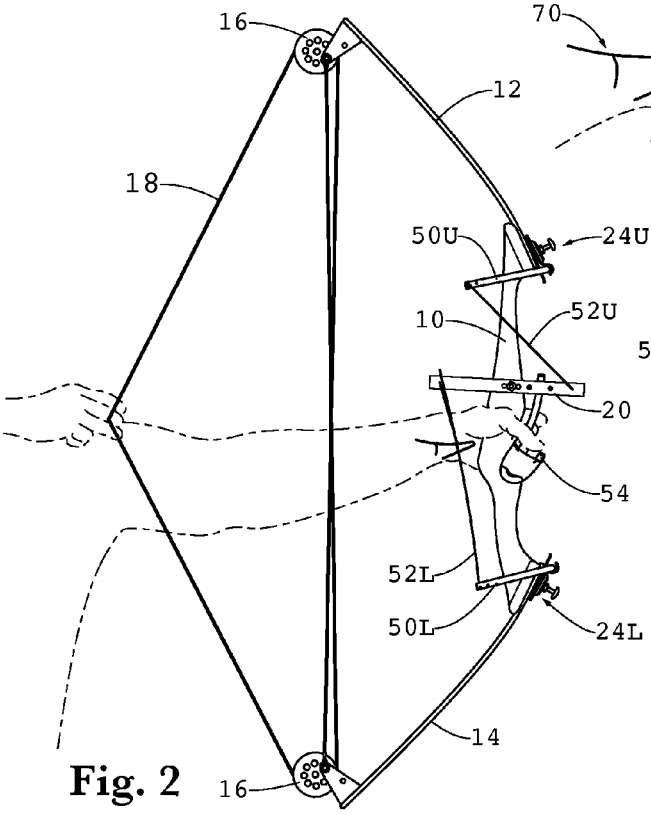
Fig. 2

Fig. 6
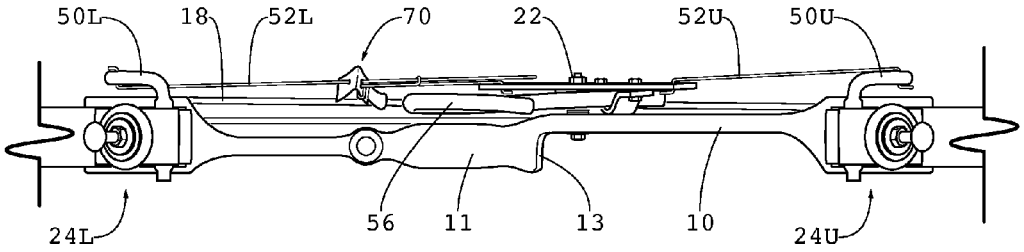
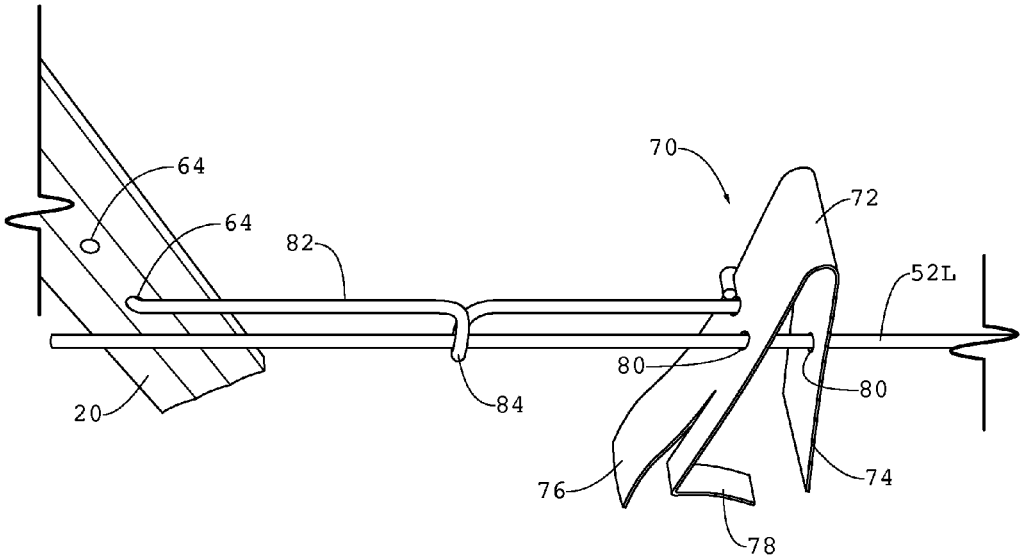
Fig. 7

Fig. 14
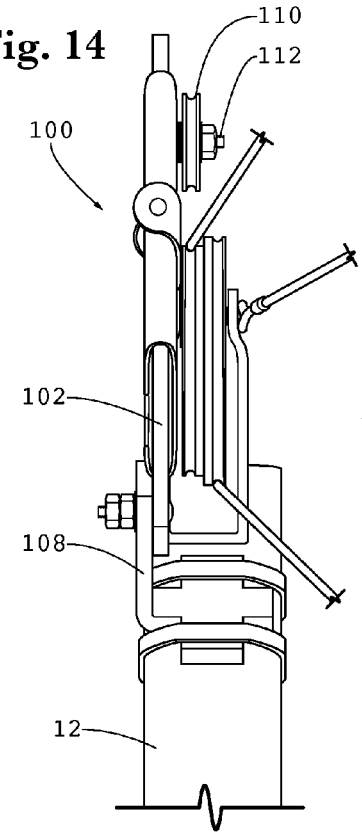
Fig. 15
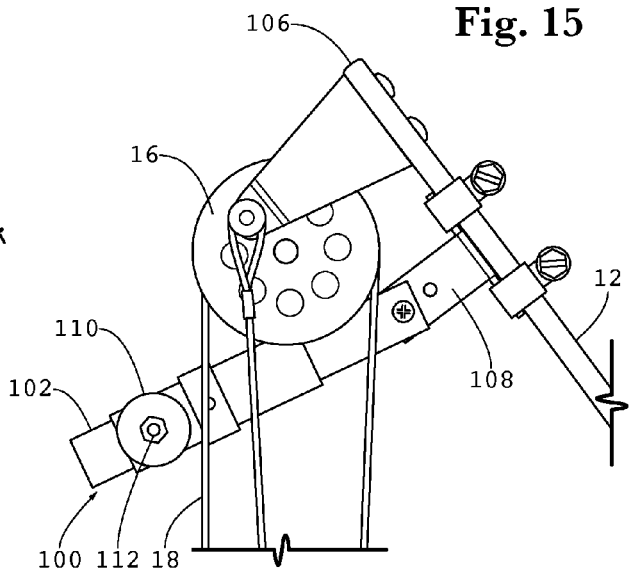
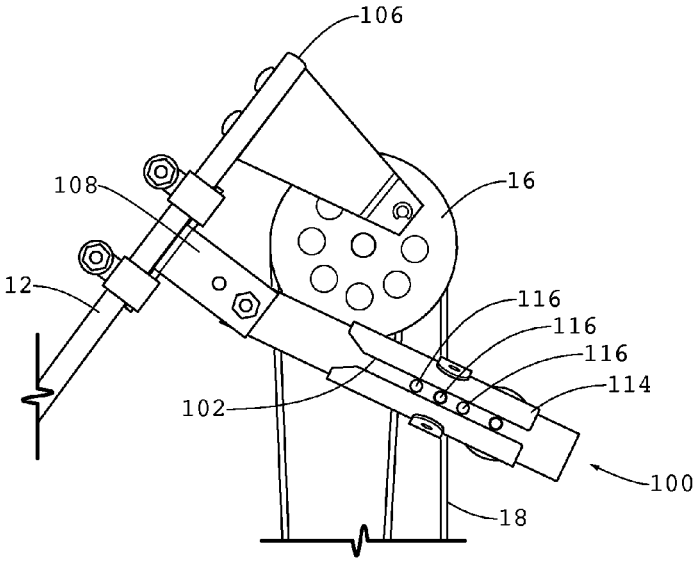
Fig. 16

Fig. 17
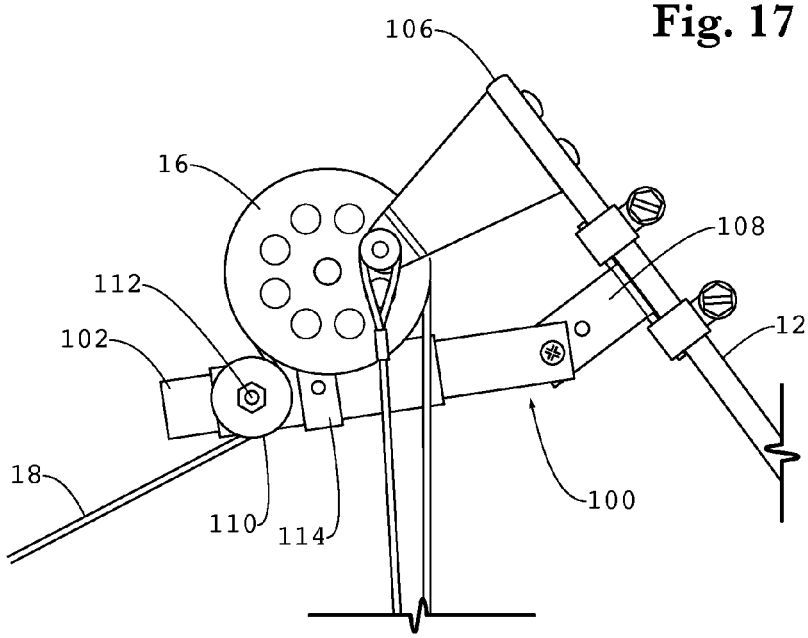
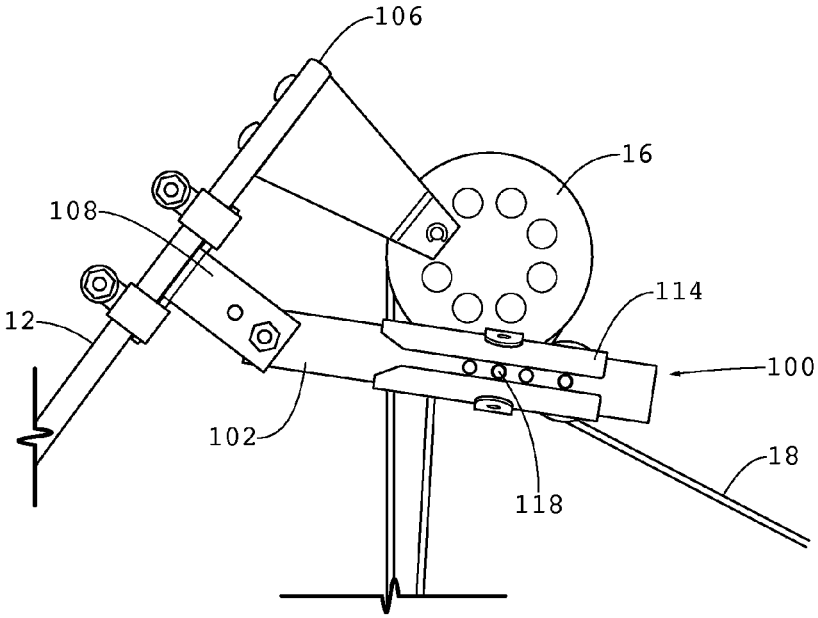
Fig. 18

COMPOUND BOW DRAW WEIGHT ADJUSTER OPERABLE AT FULL DRAW AND LOFT ADJUSTING RELEASE AND TROLLEY ARM

CROSS-REFERENCES TO RELATED APPLICATIONS (Not Applicable)

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to archery and more particularly relates to an adjustment apparatus that is attached to a compound bow and varies the draw weight of the bowstring in order to increase the potential energy stored in the bow limbs and thereby increase the power, speed, trajectory and penetration of the arrow. A particular advantage of the adjuster of this invention is that it allows the bow draw weight to be increased while the bowstring is pulled back. There are several desirable results from that capability which are subsequently described.

Archery is a historically traditional as well as a modern sport that is enjoyed for both competition and for hunting. Over the last half century, the compound bow has become a popular option for archers because of its advantageous characteristics. As with all bows, the limbs of the bow are cantilever springs that are fixed at their inner ends to a central frame called a riser and attached at their outer ends to a bowstring. The limbs store potential energy as they are bent back, within their elastic limit, by the force of an archer's arm drawing back on the bowstring. The most important characteristic of the compound bow is that the energy stored in its limbs, at a selected or standard draw length, is greater than the energy stored in a conventional bow and the draw force required to hold the bowstring at full draw is not only less than the maximum draw force (draw weight) required to draw the bowstring to full draw but also is considerably less than the draw weight of a conventional bow (which is maximum at full draw).

As the bowstring of a compound bow is drawn back, the draw force initially increases but, as the bowstring approaches full draw, the draw force is reduced. As a result, the archer is able to retain the bowstring at full draw while exerting a considerably smaller force on the bowstring than the maximum draw force of the compound bow and at an even smaller draw force than a conventional bow. The "let off" is the draw force reduction for a compound bow and can be as much as 70% to 80%. Additionally, at full draw the energy stored in the limbs is considerably greater than the energy stored in a conventional bow even though the draw force at full draw is considerably less. The ultimate result is that the archer is able to hold the bowstring at full draw with less draw force while simultaneously having more potential energy stored in the limbs for powering the arrow along its trajectory.

Another valuable characteristic of more sophisticated compound bows is that the tension force applied by the limbs to the bowstring, and therefore the potential energy stored in the limbs, is adjustable. This is possible because the butt end of each limb is pivotable within a limb pocket. There is a limb pocket mounted at each end of the bow's riser, one pocket for each limb. A loading end segment of each limb, which is the segment between a limb pivot and the butt end of the limb, has a limb bolt extending through a hole in the loading end segment and into anchoring attachment in the riser. Rotation of the limb bolt, or a nut on the limb bolt, in one direction forces the loading end segment of the limb closer to the floor of the limb pocket to increase the bend of the limb and thereby increase the potential energy stored in the limb. Alternatively, rotation of the limb bolt or its nut in the opposite direction allows the loading end segment of the limb to move away from the floor of the limb pocket to decrease the stored energy. However, these adjustments in the prior art bows can be made only when the bow is not in use for shooting an arrow.

Unfortunately, as the limb tension force is adjusted in a prior art compound bow, the required draw force is also changed. Increasing the potential energy stored in the limbs in the above-described manner increases the required draw force at all draw positions of the bowstring. However, a natural characteristic of humanity is that some archers have greater hand, arm and shoulder strength than others. Consequently, when the limbs are adjusted to increase the stored potential energy, the archer is required to apply a greater force to the bowstring. As the bowstring is drawn back, the initial draw force required by a compound bow is greater than the initial draw force required by a conventional bow. As the bowstring continues being drawn back, the required draw force increases even further beyond the draw force required by a conventional bow until the draw force reaches a maximum draw force. Only after reaching the maximum draw force does continued draw back result in the required draw force falling considerably below the maximum and considerably below the draw force for a conventional bow.

This operational characteristic means that, if a prior art bow is adjusted to increase the potential energy stored in its limbs, an archer with less strength must apply an increased initial and maximum draw force in order to reach full draw. Although the characteristics of the compound bow and the possibility of increasing the stored potential energy are of value to most archers, the requirement for increased initial and maximum draw force may require a draw force that is beyond the archer's practical strength. Consequently, such an archer may not be able to increase the stored potential energy with a prior art bow.

It is therefore an object and purpose of the present invention to provide a draw weight adjuster that permits an archer to increase the potential energy stored in the limbs without any increase in the required initial or maximum draw force.

BRIEF SUMMARY OF THE INVENTION

A compound bow draw weight adjuster permitting the draw weight to be adjusted by an archer with the bowstring at full draw. A toggle arm is pivotally mounted to the riser of the bow at a toggle arm fulcrum. A limb deflector is positioned on the riser at a loading end segment of each limb. Each limb deflector has a cam cap spaced from the loading end segment of the limb, a cam interposed between the cam cap and the loading end segment of the limb, a fastener extending through the cam cap and through the loading end segment of the limb of the bow and anchored in the riser, and a cam extension lever fixed to the cam for rotating the cam. A first cam link is connected between the toggle arm at one side of the toggle arm fulcrum and a first one of the cam extension levers for rotating its cam. A second cam link connected between the toggle arm at the opposite side of the toggle arm fulcrum and a second one of the cam extension levers for rotating its cam.

The invention also contemplates a bow having a trolley arm mounted to its upper limb for lofting an arrow. The trolley arm has an arm that is pivotally connected at a pivot axis to the upper limb of the bow. The arm is spaced from the upper end of the limb and is rotatable so it can extend aft of the limb. A pulley is rotatably mounted to the arm at a position spaced from said pivot axis by a distance that permits the pulley to be positioned aft of the bowstring so that an outer peripheral surface of the pulley engages the bowstring when the bowstring is drawn.

BRIEF DESCRIPTION OF THE SEVERAL VIEWS OF THE DRAWINGS

FIG. 1 is a view in side elevation of a compound bow on which an embodiment of the invention has been mounted and with the bowstring pulled to full draw but the embodiment of the invention not actuated.

FIG. 2 is a view in side elevation of the compound bow of FIG. 1 but showing the embodiment of the invention as actuated.

FIG. 3 is a closer view in side elevation of the compound bow of FIG. 2 but showing the embodiment of the invention in larger scale.

FIG. 6 is a view in front elevation of the central portion of the bow as shown in more detail in FIG. 3.

FIG. 7 is a close up detailed view in perspective of the cam link length adjuster and release of the invention.

FIG. 14 is a view in rear elevation of the trolley arm embodiment illustrated in FIG. 15.

FIG. 15 is a view in side elevation of the trolley arm embodiment of the invention with the bowstring in its relaxed state.

FIG. 16 is a view in side elevation of the opposite side of the embodiment illustrated in FIG. 15.

FIG. 17 is a view in side elevation like the view of FIG. 15 but with the bowstring at full draw.

FIG. 18 is a view in side elevation like the view of FIG. 16 but with the bowstring at full draw.

Figure 4:
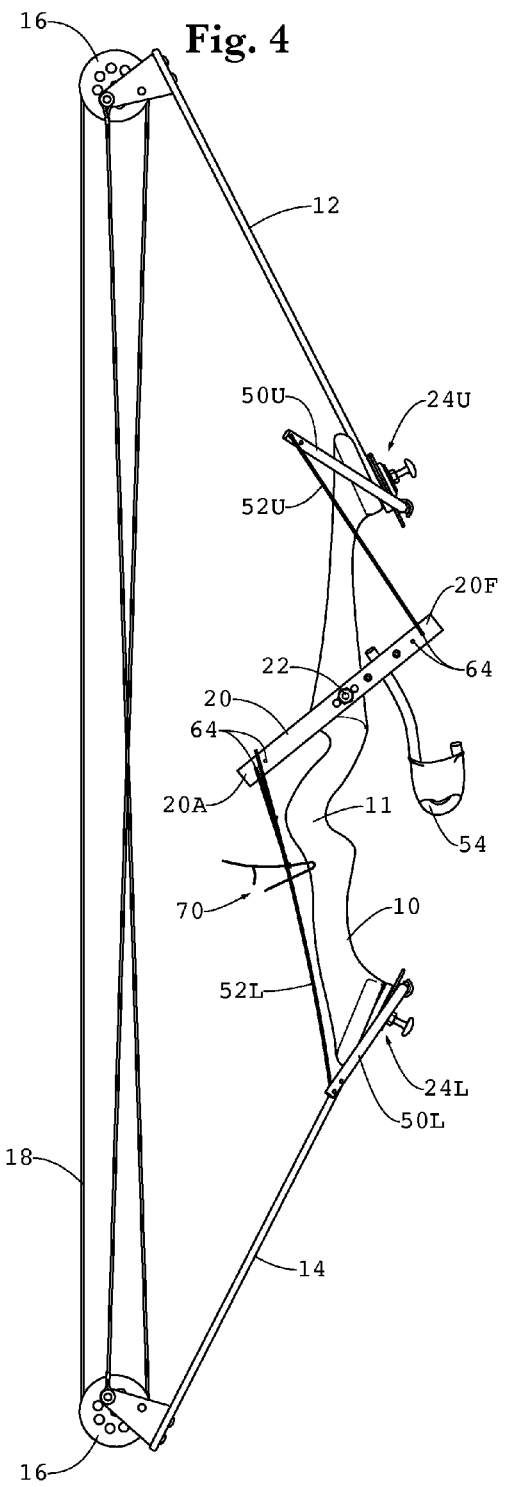
FIG. 4 is a right side view in elevation of the bow of FIG. 1 with the bowstring undrawn.
Figure 5:
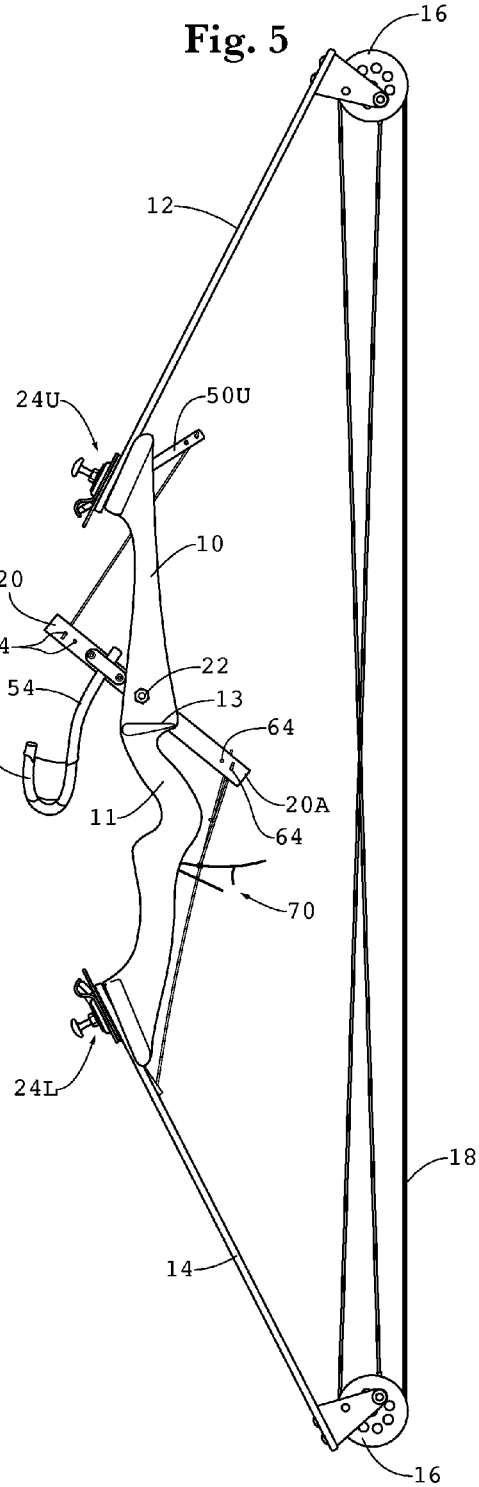
FIG. 5 is a left side view in elevation of the bow of FIG. 1 with the bowstring undrawn.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

The principles of the operation of a compound bow that are described above are described in or evident from U.S. Pat. No. 3,486,495 which is incorporated by reference in this application. This patent is believed to be the original U.S. patent on the compound bow.

The principal advantage of the draw weight adjuster of this invention is that it allows the bow draw weight, and therefore the stored potential energy, to be increased after the bowstring is pulled back near or to the archer's draw length. Consequently, the draw weight can be increased while the drawstring is pulled back to the position where the required draw force has been considerably decreased by the well-known operation of the compound bow. Therefore, the initial pull force and the maximum draw force are the same as they are if the draw weight was never increased. These forces are the same because, while the bow string is being drawn back, the draw weight and stored potential energy have not yet been increased. Additionally, when the invention is used to increase the draw weight, that increase occurs while the archer has the benefit of the let off. Consequently, the increase in draw force from actuation of the present invention is only increased by the let off factor.

An additional advantage of the invention is that the bowstring can be drawn to and held at full draw and the draw weight increase can be postponed until immediately before the archer is going to release the bowstring to shoot the arrow. That postponement minimizes the length of time that the shooter is required to hold the drawstring in its fully pulled back position at the increased draw weight, such as when waiting for a target prey to move to a position without any obstructions between the archer and the prey. Furthermore, with the invention the draw weight adjustment requires only a minor, short distance movement of the archer's fingers that causes rotation of a toggle arm that is located forward of the bow's hand grip. Therefore, if an archer is hunting, that minor motion does not attract the attention of the prey.

Yet a further advantage of the invention is that it permits variable and differing amounts of adjustment. The amount of draw weight increase is determined by the distance of finger movement on the archer's hand that is seated against the hand grip of the bow's riser. This allows the archer to adjust for target distance by the amount that the archer has learned by practice will compensate for the arrow drop over the estimated distance to the target.

Referring now to the figures, FIGS. 1 through 6, show an embodiment of the invention mounted to a conventional, prior art, compound bow. The bow includes a riser 10 with a central hand grip 11 and an arrow shelf 13 above the hand grip 11. An upper limb 12 and a lower limb 14 are attached respectively at the upper and lower ends of the riser 10. The limbs are cantilever springs that apply oppositely directed forces against opposite ends of the bowstring. Mounted to the outer ends of the limbs 12 and 14 are conventional cams or eccentric wheels 16 with a bowstring 18 strung over them in the conventional manner.

The terms forward and aft, upper and lower, above and below, and central and outer are used with reference to the normal position of the bow when held by an archer in the operating, shooting position. Forward refers to the direction toward the target, aft refers to the direction back toward the archer. Upper refers to the part of the bow that is above the hand grip of the riser and lower refers to below that hand grip. Above means at a greater height and below means at a lower height. Central means toward the center of the riser and outer means outward from the center of the riser.

The draw weight adjuster of the invention is attached to the conventional compound archery bow. The draw weight adjuster has a toggle arm 20 that is pivotally mounted to the riser 10 at a toggle arm fulcrum 22. Each limb has a limb deflector 24 attached to the riser 10 for adjusting the tension of its associated limb. The upper limb 12 is adjusted by the upper limb deflector 24U and the lower limb 14 is adjusted by the lower limb deflector 24L. Rotation of the toggle arm 20 operates the limb deflectors 24 in a manner that will be described.

The limb deflectors 24 are illustrated in more detail in FIGS. 8-13. They can be summarized as each having a cam that is rotated by a cam extension lever to adjust the deflection of the limbs and thereby adjust their spring tension and the potential energy stored in the limbs when the bowstring is drawn. The two limb deflectors 24 are identical and therefore one is described. Referring to FIGS. 8-13, the limb deflectors 24 are positioned on the riser 10 at the loading end segment 26 of each limb. The loading end segment 26 of each limb, such as limb 12, is the segment of the limb that extends centrally from a limb fulcrum 28 to the butt end 30 of the limb.

Deflection of the loading end segments 26 toward the riser bends the limbs to apply more spring force against the bowstring. More specifically, in one direction of operation, the limb deflector 24 deflects (bends) the limb to increase the limb tension by moving the loading end segment 26 of the limb closer against the riser 10. In the opposite direction of operation, the limb deflector 24 relieves the limb tension by allowing the loading end segment 26 to be moved away from the riser 10 by the spring force of the limb.

Figure 12:
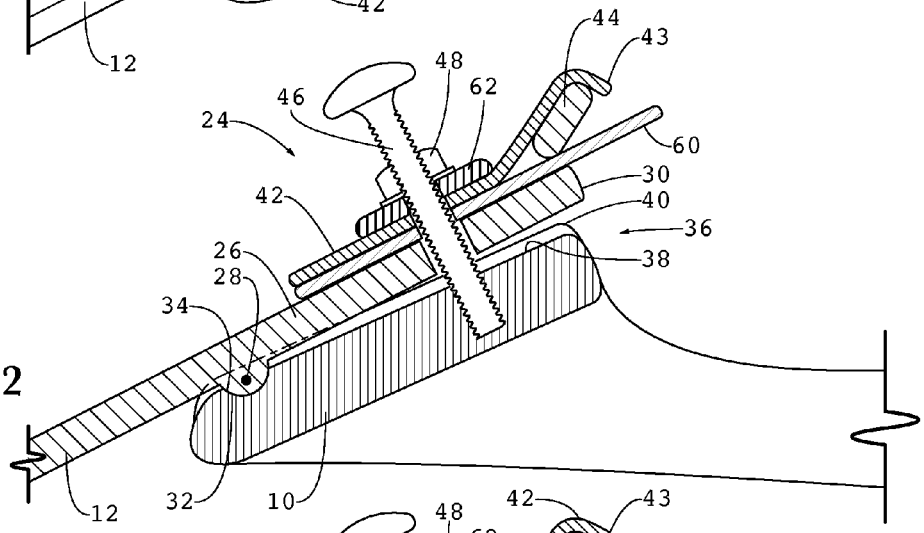
FIG. 12 is a view in vertical section of a limb deflector before rotation of the cam to increase the draw weight of the preferred embodiment of the invention.
Figure 13:
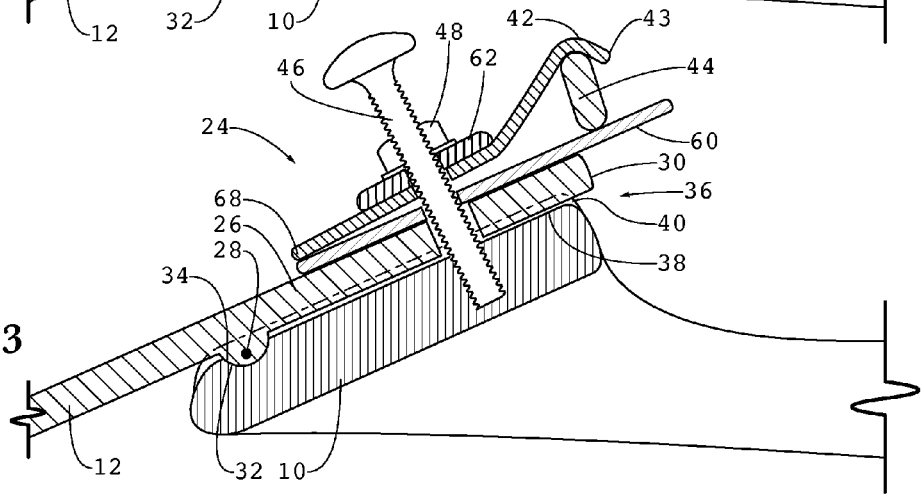
FIG. 13 is a view in vertical section like FIG. 12 but after rotation of the cam to increase the draw weight of the preferred embodiment of the invention.

In order to permit adjustment of the limb tension by deflection of the loading end segment 26, it is necessary that there be a limb fulcrum. There are different ways known in the art for providing a limb fulcrum, including a pivot pin and a limb rocker pivot, both of which can be used with the present invention. Referring particularly to FIGS. 12 and 13, the illustrated limb fulcrum is provided by a limb rocker pivot. The limb rocker pivot has a channel 32, for example with a semi-cylindrical contour. The limb 12 has a mating protrusion 34 that rotatably slides within the channel 32. This provides a virtual fulcrum in the sense that there is no axle or other pivot at the fulcrum. The structures are concealed from view in the assembled bow because the rocker pivot and the loading end segment 26 of the limb are at least partially surrounded on three sides by a limb pocket 36. The limb pocket 36 is formed by a limb pocket floor 38 and limb pocket sidewalls 40. Deflection of the loading end segment 26 of the limb 12 closer to the floor 38 increases the spring tension on the limb 12 and deflection of the loading end segment 26 of the limb 12 farther from the floor 38 decreases the spring tension of the limb 12.

Each limb deflector 24 includes a cam cap 42 spaced from the loading end segment 26 of the limb 12. A cam 44 is interposed between the cam cap 42 and the loading end segment 26 of the limb 12. A fastener 46 extends through the cam cap 42 and through the loading end segment 26 of the limb 12 and is anchored in the riser 10. The fastener 46 has an expanded head 48 preventing the cam cap 42 from sliding off the fastener 46. As illustrated, the preferred fastener 46 is a threaded screw with male threads engaged in mating female threads in the riser 10. The preferred expanded head 48 is a nut that is threadedly engaged to the screw. The nut allows convenient and independent adjustment of the nut's position on the screw without unscrewing the screw itself from being firmly anchored in the riser. For retro-fitting an aftermarket embodiment of the invention on an existing prior art bow, the screw is dimensioned identically to the limb bolt that comes with a prior art bow. Alternatively, the expanded head can be a conventional screw head, a nut on a threaded rod, a pin diametrically through the fastener or other structure for preventing the cam cap 42 from sliding off the fastener 46.

Figure 8:
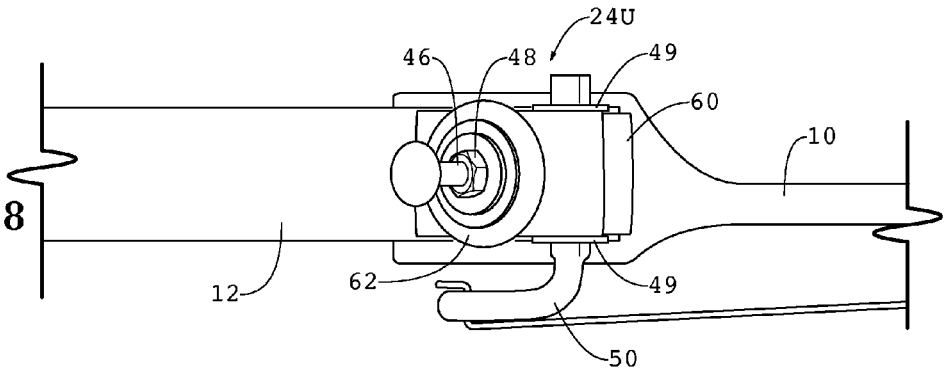
FIG. 8 is a view in front elevation of the upper limb deflector of the preferred embodiment of the invention.
Figure 9:
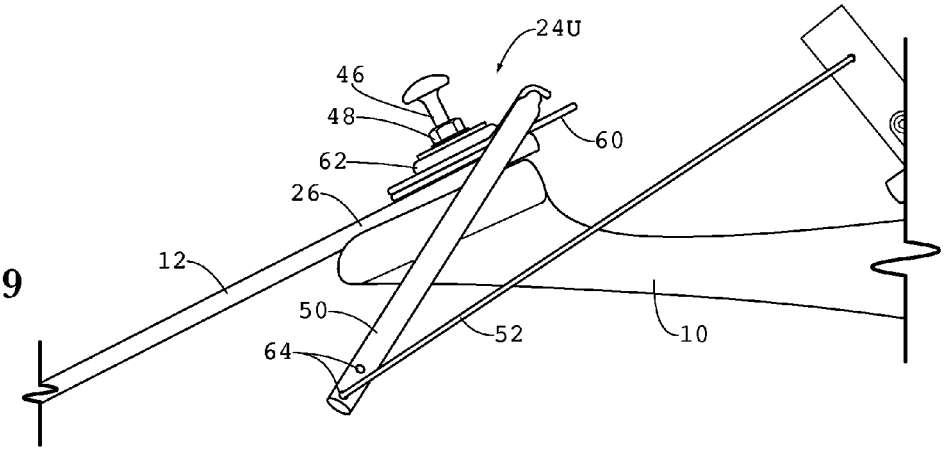
FIG. 9 is a right side view in elevation of the upper limb deflector illustrated in FIG. 8.
Figure 10:
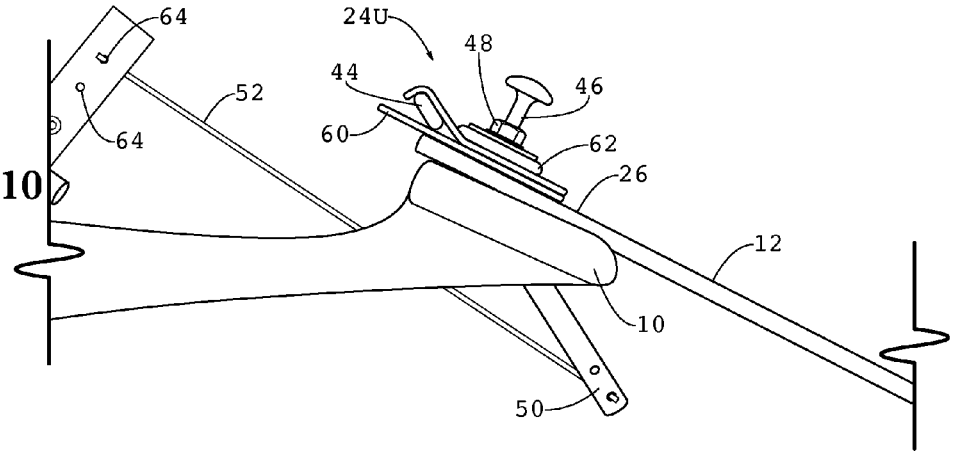
FIG. 10 is a left side view in elevation of the upper limb deflector illustrated in FIG. 8.
Figure 11:
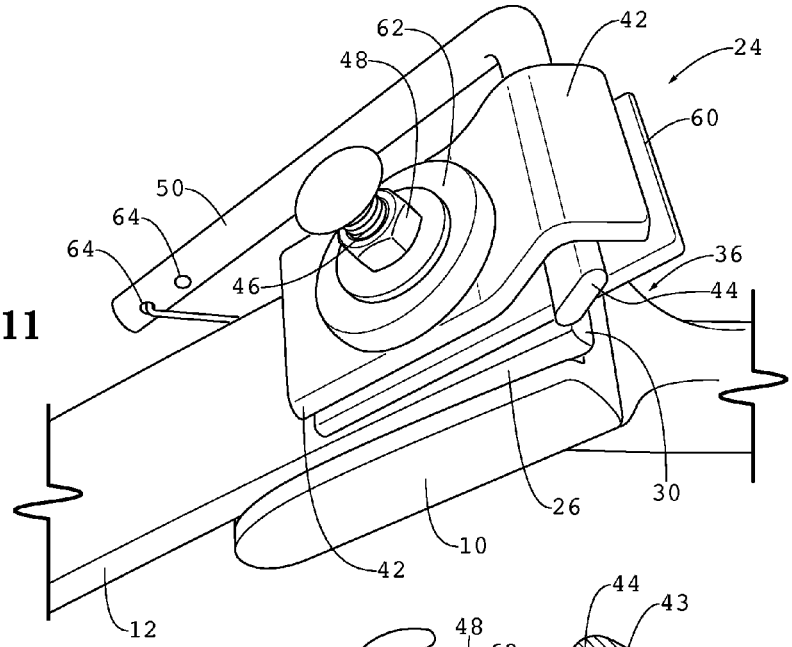
FIG. 11 is a view in perspective of the upper limb deflector illustrated in FIG. 8.

The function of each cam 44 is to deflect the loading end segment 26 of its associated limb by the rotation of the cam 44. The shape of the cam 44 is preferably a racetrack oval. It is an approximately oval shape but with linear opposite sides so that it has a major axis extending through symmetrical opposite lobes with its axis of symmetry at its axis of rotation. However, other cam configurations, such as a cam with an eccentric lobe, can also be used. Additionally, it is desirable that keepers, such as expandable retaining rings seated in annular grooves or pins through diametrical holes, be mounted at opposite ends of the cam 44 so that the cam 44 is retained between the cam cap 42 and the cam follower 60 and cannot slide axially from between them. As an example, retaining rings 49 are illustrated in FIG. 8 at opposite ends of the cam 44. However, the retaining rings are not illustrated in the other figures because they would block conceal the cam and other structures lying beneath them.

A cam extension lever 50 is fixed to the cam 44 for rotating the cam 44. Other figures show the upper cam extension lever 50U and the lower cam extension lever 50L. As illustrated, the cam 44 and the cam extension lever 50 can each be advantageously formed from a bent rod with the cam 44 formed at the shorter segment of the bent rod.

Cam links 52 connect the cam lever arms 50 to the toggle arm 20 so that rotation of the toggle arm rotates the cams 44. The cam links 52 extend from opposite sides of the toggle arm fulcrum 22 to the cam extension levers 50. The preferred cam links 52 are wires because wire is both light weight and strong in tension. It will be apparent to those skilled in the mechanical arts that rigid cam links could be used but they would add unnecessary weight to the bow. A first cam link 52U is connected between the toggle arm 20 at one side of the toggle arm fulcrum 22 (FIG. 3) and a first one of the cam extension levers 50U for rotating the cam 44 in the upper limb deflector 24U. A second cam link 52L is connected between the toggle arm 20 at the opposite side of the toggle arm fulcrum 22 and a second one of the cam extension levers 50L for rotating the cam 44 in the lower limb deflector 24L. As seen in the figures, the preferred wire cam links 52 extend through holes in the toggle arm 20 and holes in the cam links 52. In order to prevent the wire cam links 52 from pulling out of the holes, their ends are bent over 90° so they are retained in the holes in the manner of carburetor linkages.

The toggle arm 20 can have its fulcrum above or below the hand grip 11 of the riser 10. In the illustrated embodiment, the toggle arm 20 is pivotally mounted to the riser 10 with the toggle arm fulcrum 22 above the hand grip 11. With the preferred wire cam links, the upper cam link 52U is connected between the forward extending segment 20F of the toggle arm 20 and the upper cam extension lever 50U. The lower cam link 52L is connected between an aft extending segment 20A of the toggle arm 20 and the lower cam extension lever 50L.

The toggle arm 20 is a lever that is linked through the cam links 52 and cam extension levers 50 to the cams 44. Rotation of the toggle arm 20 rotates the cam 44 which in turn varies the limb deflection of the loading end segments 26 of the limbs between the limits of their range of limb deflection within the limb pockets 36. The toggle arm 20 includes a hand trigger 54 that the archer uses to manually rotate the toggle arm 20. When not actuated, the hand trigger 54 extends to a position spaced forward of the bow's hand grip 11 by a distance that allows the archer, while holding the bow with the bowstring pulled back, to extend the archer's fingers forward and over the hand trigger 54. The archer uses one or more of the fingers of the hand on the hand grip 11 to pull the hand trigger 54 aft and thereby rotate the toggle arm 20. Rotation of the toggle arm 20 applies a tension force, through the cam links 52, to the cam extension levers 50 causing the cam extension levers 50 to rotate the cams 44. Rotation of the cams 44 deflects the loading end segments 26 of the limbs closer to the floors 38 of the limb pockets 36 to increase the limb tension and increase the potential energy stored in the limbs.

Although the toggle arm 20 is illustrated as having a hand trigger 54 that is a separate component part attached to a linear component part of the toggle arm 20, it should be apparent to those skilled in the mechanical arts that the toggle arm 20 can, alternatively, easily be formed as a unitary body. The distance that the hand trigger 54 is positioned forward of the grip 11 is, of course, dependent upon the finger length of the archer. I have found that about 2 inches forward of the hand grip is comfortable, although I believe that it should be in the range of 1 inch to 3 inches. It is also desirable that the hand trigger 54 have a bend 56 laterally away from the hand grip 11, as illustrated in FIG. 6. The purpose of the bend 56 is to allow the hand trigger 54 to pass beside the hand grip 11 as the hand trigger 54 is pulled back by the archer's fingers. This allows the travel of the hand trigger 54 to pass beside the hand grip 11 so that the angle of rotation of the entire toggle arm 20 can be more than would be possible if the hand grip 11 was stopped by colliding with the hand grip 11.

Although not necessary, it is desirable that the hand trigger 54 also has a hook-shaped trigger extension 58 that extends further forward than the closer part of the hand trigger 54 in order to provide a secondary hand trigger. The trigger extension 58 gives the archer a secondary position at which the archer's fingers can grasp the hand trigger 54. This allows an archer with sufficiently long fingers to initially grasp the trigger extension. This also allows the archer to initially grasp the part of the hand trigger 54 that is closer to the riser 10 and then shift the archer's fingers to the trigger extension 58 after the toggle arm 20 is pulled partially aft. Pulling on the trigger extension 58 allows the hand trigger to be pulled even further aft for further increase in the energy stored in the limbs.

Referring again to FIGS. 8 through 13, it is also desirable to provide a cam follower 60 interposed between each cam 44 and the loading end segment 26 of the limb. The fastener 46 also extends through the cam follower 60. The principal purpose of the cam follower 60 is to provide a wear plate to prevent the friction of the rotating cam 44 from wearing into the loading end segment 26 of the limb. With sufficient lubrication the cam follower 60 may be unnecessary but it is preferred. Additionally, if the loading end segment 26 of the limb is short, the cam follower 60 functions as an extension of the loading end segment 26. Desirably, the surfaces of the cam follower 60 and the cam cap 42, which contact the cam 44, can be provided with an anti-friction layer or surface coating such as Teflon®.

It is also desirable that a resilient elastic washer 62 is interposed between the expanded head 48 of the fastener 46 and the cam cap 42. The resilient elastic washer 62, constructed for example of a rubber material, acts like a spring that gives a smoother or cushier and softer feel that smoothens the transition as the hand trigger 54 is pulled back and the cams 44 are rotated.

As seen from the above description, the invention has various levers that are connected to other levers by a link that permits motion of one lever to be transmitted to, and thereby rotate, another lever. The toggle arm 20 of the invention is a lever as are other structures that are named levers. A lever is a body that pivots at a fulcrum on the lever. A lever extends in opposite directions or in one direction from the fulcrum. Two forces are applied to the lever at two different points on the lever. Those points where forces are applied are spaced from the fulcrum. The distance from the fulcrum to a point where a force is applied is a lever arm. The levers of the invention preferably have adjustable lever arms. In some instances there are several points that are spaced apart along the lever to which a force may be applied. As described below, there are a series of holes in the levers and a wire cam link 52 may be connected to a selected one of the spaced holes in each lever. The distance from the fulcrum to the selected point is the lever arm. The point of this discussion is that the length of an operating lever arm of a lever can be changed without changing the physical length of the lever itself. The length of a lever does not change when a different hole is selected even though the lever arm is changed.

A desirable enhancement of the present invention is to use those lever principles to allow an archer to make adjustments to the invention to accommodate variations in the strength of different archers and to allow an individual archer to make adjustments to accommodate variations in the strength of the individual archer over time and to do some fine tuning of the invention as the archer gains experience with the invention. For this purpose, the toggle arm 20 and the cam extension levers 50 are each provided with a series of longitudinally spaced holes 64 for selective attachment of the cam links 52. These holes permit adjustment of their lever arm lengths. As known to those skilled in the art, levers provide a mechanical advantage that is determined by the length of their lever arms. Because the toggle arm 20 and the cam extension levers 50 function as levers and they are mechanically linked by the cam links 52, changing the point of attachment of the cam links 52 to those levers changes the mechanical advantage and the ratio of the rotation angle of the toggle arm 20 to the rotation angle of the cam extension levers 50. Consequently, changing the hole to which the cam links 52 are attached to those two levers changes both the force that must be applied to the hand trigger 54 to rotate it and the angular rotation of the cams 44 for a given or selected amount of hand trigger 54 rotation. As experience with the invention is acquired, the archer can change the point of connection of the cam links 52 to suit the archer's preferences.

As stated above, the cam extension levers 50 are fixed to the cams 44 for rotating the cams 44 by manual rotation of the toggle arm 20. There is a phase relationship between the cam extension lever 50 and the axis of rotation of each cam 44. An oval cam has a major axis and a minor axis. In the preferred embodiment, the major axis is parallel to the cam extension lever. An eccentric cam would have a corresponding major radial axis extending through its peak or largest distance from its axis of rotation. However, it should be apparent that the angular phase relationship can be made other than 90°.

Additionally, cams have a major and a minor axis and the ratio of those axes determines the distance of the movement of structures that seat against the cam and are moved by the cam. The cam of the present invention can be manufactured with different dimensions so that the amount of limb deflection per degree of cam rotation can be selectively chosen. Different ratios between the length of the major and minor axes of the cam result in different distances of deflection of the loading end segments of the limbs.

The operation of the cam 44 to increase the spring tension of the limbs can be seen in FIGS. 12 and 13. If the cam 44 is, as in FIG. 12, oriented with its major axis inclined at approximately 45° to the cam follower 60, the spacing between the cam follower 60 and the cam cap 42 is at its minimum so that the bend of the limb, and therefore the limb tension, is at its minimum. As the cam 44 is rotated toward the position illustrated in FIG. 13, with its major axis nearly perpendicular to the cam follower 60, the loading end segment 26 of the limb is pushed closer to the floor 38 of the limb pocket 36. That movement increases the deflection of the loading end segment 26 to increase the limb spring tension and the stored energy. As the cam 44 is rotating between these two positions, the spring force applied by the loading end segment 26 against the cam 44 opposes the rotation of the cam so that the cam link 52 is maintained in tension by that spring force. That spring force also returns the cam 44 to the position of FIG. 12 when the archer releases the hand trigger 54. The lengths of the lever arms of the toggle arm 20 and the cam extension levers 50 and the length of the cam links 52 should be chosen by the designer and adjusted by the archer so that the cam does not rotate beyond the position illustrated in FIG. 13. For the preferred cam 44 illustrated in the drawings, that allows a maximum rotation angle of the cam 44 of approximately 45°. However, by changing the lever arm lengths the archer can adjust the angle of cam rotation to within a smaller or larger range of rotation angle.

As also seen in FIGS. 12 and 13, in the preferred embodiment the limb deflection is partly the result of the movement of the cam 44 against the cam follower 60 to force the loading end segment 26 of the limb toward the floor 38 of the limb pocket 36. In addition, the movement of the cam 44 against the cam cap 42 pushes the central end 43 of the cam cap 42 away from the cam follower 60 causing the cam cap 42 to rotate and become inclined to the fastener 46 as shown in FIG. 13. This is possible only if the opening in the cam cap 42, through which the fastener 46 extends, has a sufficiently large clearance gap. The cam cap 42 pivots with its fulcrum where the fastener 46 passes through the opening in the cam cap 42. As a result, the outer end 68 of the cam cap 42 pushes against the cam follower 60 to also assist in deflecting the loading end segment 26 of the limb towards the floor 38 of the limb pocket 36. In a sense the cam cap 42 and the cam follower 60 function together as a double cam follower.

As an alternative, the cam cap 42 can be mounted so that it cannot rotate with respect to the fastener, such as by making the fastener opening in the cam cap 42 a close tolerance fit. That way all of the limb deflection is directly from the cam 44 moving against the cam follower 60.

Some risers of some modern compound bows are constructed of a composite material and formed with a net-like or honeycomb-like material with openings surrounded by interconnecting webs of the composite material. As a result, there is often no sufficiently large part of their riser for attachment of a pivot fulcrum for the toggle arm. Similarly, the material of a solid riser, like the riser illustrated in the figures, may not be sufficiently hard or durable for attachment of a pivot for the toggle arm. In these situations a mounting plate 66 (FIG. 3) can be fixed to the riser and the toggle arm 20 can be pivotally mounted to the mounting plate 66. The mounting plate 66 allows the use of a larger number of smaller fasteners, such as screws, to attach the mounting plate 66 to the riser 10 in order to distribute the load over a larger area. For a composite bow riser with the honeycomb configuration, a second similar plate can be positioned on the opposite side of the riser and small bolts used to connect the plates together and clamp the riser between the plates.

As a further enhancement of the preferred embodiment of the invention, a cam link length adjuster and release 70 can be connected in either one or both of the cam links 52. This will be referred to as the link adjuster 70 for brevity and is preferably connected in the lower cam link 52L. FIG. 7 illustrates the details of the link adjuster 70. A springy steel strip is formed into a V-shaped clip 72 which has two spread-apart legs 74 and 76. The clip 72 also has a protruding tab 78 on one of its legs 76. The tab 78 engages the other leg 74 and retains the legs 74 and 76 together when the legs 74 and 76 are pinched together. The tab 78 releases the other leg 74 when the tab 78 is deflected away from the other leg 74 to allow return of the other leg 74 to the illustrated spread-apart configuration. The clip 72 has a pair of close tolerance holes 80, one hole 80 in each leg 74 and 76 of the clip 72. One wire of the cam link 52L is attached to the toggle arm 20 at one end and extends through the holes 80 to a free end. A secondary wire 82 is fixed to the leg 76 of the clip 72 at one end and is attached to the toggle arm 20 at its opposite end. The illustrated manner of connecting the secondary wire 82 to the leg 76 is that the wire 82 extends through a hole in leg 76 into the space between the legs 74 and 76 and then is bent 90° to pass along the inward facing surface of the leg 76. The secondary wire is then bent 180° further all the way around the side edge of the leg 76 onto the outward facing surface of the leg 76.

The link adjuster 70 has two alternative modes of function. In the first mode it permits the archer to adjustably vary the length of the cam link 52L. This change in length changes the amount of angular rotation of cam 44 (i.e. its starting angle) and therefore changes the amount of limb end segment deflection when the toggle arm 20 is rotated. In the preferred embodiment, a longer cam link 52 results in less deflection when the toggle arm 20 is rotated and a shorter cam link 52 results in more deflection. The length can be adjusted because, when the clip 72 is in its spread apart configuration, sharp edges around the holes 80 through which the cam link 52L passes grip the wire cam link 52L and prevent it from moving with respect to the secondary wire 82. In this first mode, a tension force applied to the wire cam link 52L is applied to the secondary wire 82 so that the toggle arm 20 can rotate the cam extension lever 50L in the manner described above.

If selected by the archer, the second mode permits the cam link 52L to freely slide with respect to the toggle arm 20 so that rotation of the toggle arm 20 does not move the cam extension lever 50L to which the cam link 52L is otherwise normally attached. This occurs because, when the clip 72 has the legs 74 and 76 held together by the tab 78, the wire cam link 52L simply slides through the holes 80 through which it passes. In this mode, no tension force is applied by the toggle arm 20 to the cam extension lever 50L so the cam extension lever 50L does not rotate. Advantageously, a wire loop 84 is formed in the secondary wire 82 and the wire cam link 52L freely slides through that loop 84 and does not rotate the cam extension lever 50L in the second mode of operation. Because the cam extension lever 50L does not rotate, only the limb tension force of the upper limb 12 is increased when the toggle arm 20 is rotated.

The consequence is that the limb tension forces are slightly unbalanced. That causes the tiller for the upper limb to be less than the tiller of the lower limb. The "tiller" of a bow is the distance from the point where the limb meets the riser to the bowstring along a line that is perpendicular to the bowstring when not pulled aft by the archer. The result of this unbalanced tiller is believed to be that the arrow lofts more; that is, the arrow rises or lifts as it initially leaves the bow. Furthermore, it is believed that the greater the tiller unbalance, the greater is the loft. This feature can be used to compensate for some or all of the gravitational drop in the trajectory of the arrow as it flies to the target. Experimentation with a prototype indicated that this feature could compensate for all of the gravitational drop if the target was close enough to the archer but only partially compensated for the gravitational drop for a more distant target. For more distant targets, the "trolley arm" that is subsequently described below provides considerably greater compensation.

The theory of this operation is as follows. When the bowstring is drawn, the limb with the greater tension is not pulled aft as far as the limb with the lesser tension. In other words the tiller for the limb with the greater tension is less than the tiller for the limb with the lesser tension. That causes the bowstring to be inclined slightly after it is released and as it travels toward the riser. In other words, if the upper limb has the greater tension, the bowstring is inclined so that the upper end of the bowstring is further forward than the lower end of the bowstring. Therefore the arrow trajectory is not perfectly perpendicular to the undrawn bowstring. Instead, the angle between the arrow and the bowstring as the nock departs from the bowstring will be slightly acute for the angle above the arrow and will be slightly obtuse for the angle below the arrow. This incline of the bowstring as it moves forward causes the force applied by the bowstring against the nock of the arrow to have a slightly downward component. Therefore, as the arrow slides across the arrow shelf, the nock end of the arrow is slightly lower than the arrowhead end thereby raising the head end so the arrow rises as it is released.

The preferred operation of a bow having an embodiment of the invention is illustrated in FIGS. 1 through 3. As shown in FIG. 1, the archer draws the bowstring back in the conventional manner. When the archer is ready to increase the draw weight, the archer then extends forward two of the fingers from the hand that is holding the hand grip 11. The end segments of those fingers are then wrapped around the hand trigger 54. Using those two fingers, the archer pulls the hand trigger 54 aft by a desired amount as illustrated in FIGS. 2 and 3. The farther the hand grip 54 is pulled aft, the more the draw weight is increased and therefore the more the limb spring tension and the potential energy stored in the limbs is increased.

The Trolley Arm

Also described herein is an invention that can advantageously be used in combination with the above-described compound bow draw weight adjuster or alternatively can be used without that adjuster and with a conventional bow or recurve bow or any other bow. This invention is fancifully referred to as a trolley arm because of its similarity to a trolley arm of the type that has been used on electrically powered streetcars. In summary, the trolley arm of the invention is an arm that is pivotally mounted to a limb of the bow and has a pulley that engages the aft side of the bowstring when the bowstring is drawn back.

FIGS. 14 through 18 illustrate the trolley arm invention mounted to a bow like the bow that is illustrated in FIGS. 1-13. As shown in FIGS. 1-5 and described above, the bow has a centrally positioned hand grip 11 (FIG. 3), an upper limb 12 and a lower limb 14 that are attached at their outer ends to a bowstring 18. The bow has the trolley arm, designated generally 100, mounted to the upper limb 12. The purpose of the trolley arm 100 is to loft an arrow shot from the bow so that its trajectory is above the line of sight of the archer along the arrow to a target when the bowstring 18 was fully drawn. That means that, although the archer is aiming directly at the target point where he intends to hit, when the arrow is released the arrow initially rises above that line of sight. However, with proper adjustment, the arrow then falls from gravity on the way to the target and strikes the target point at which the archer was aiming at the time of release of the arrow.

The trolley arm has an arm 102 that is pivotally connected at a pivot axle 104 to the upper limb 12. The pivot axis of the pivot axle 104 is located at a position that is spaced from the end 106 of the upper limb 12. Preferably, a pivot axle support bracket 108 is clamped to the upper limb 12 and supports the pivot axle 104 to form a hinge for the arm 102. The arm 102 is rotatable at the pivot axle 104 so that the arm 102 can extend aft of the upper limb 12.

A pulley 110, having a pulley axle 112, is rotatably mounted to the arm 102 at a position that is spaced from the pivot axle 104 by a distance that permits the pulley 110 to be positioned aft of the bowstring 18. When the arm 102 is rotated so that the pulley 110 is aft of the bowstring 18, an outer peripheral surface of the pulley 110 can engage the bowstring 18 when the bowstring 18 is drawn. Although not necessary, it is desirable that the hinge connection of the pivot axle support bracket 108 to the arm 102 at the pivot axle 104 have sufficient frictional connection that the arm 102 can be manually pivoted into or out of position but will be self-supporting with the pulley 110 spaced aft of the bowstring 18. However, the arm 102 should be able to pivot about the pivot axle 104 when pushed by the force of the bowstring 18 against the pulley 110. I have found it desirable that the peripheral surface of the pulley 110 be spaced about ¼ to ½ inch aft of the bowstring 18 when the bow is relaxed.

The bowstring of most compound bows is connected to a cable at a connection that is called the teardrop. It is the cable that extends around the conventional cams of the compound bow. However, the bowstring and the cable function together as a single cord joined end to end at teardrops. Therefore the term bowstring is used to refer to the combination of the two. Nonetheless, it is desirable that the bowstring 18 engage the pulley 110 where the teardrop will not ride along the periphery of the pulley 110 when the bowstring 18 is drawn.

It is also desirable that the position of the pulley 110 along the arm 102 is adjustable to vary the distance from the upper limb 12 to the pulley axle 112. This can be accomplished by making the pulley axle 112 adjustably mountable at multiple different positions along the arm 102. That allows the archer to selectively adjust the distance from the upper limb 12 to the pulley axle 112. One manner of accomplishing that adjustability is to provide a series of transverse holes 116 that are spaced lengthwise along the arm 102 for selective attachment of the pulley axle 112. The pulley axle could be formed with an annular shoulder at an end from which a smaller threaded rod extends through one of the series of holes 116 and fastened in the selected hole by a nut.

Preferably, however, the pulley axle 112 is mounted to a carriage 114 that is slidable along the arm 102. The carriage 114 can be fixed at any one of multiple locations along the arm 102. The carriage has a transverse hole with a pin 118 that is slidable through the transverse hole in the carriage and through a selected hole 116 in the arm 102. Consequently, with the pin withdrawn, the pulley 110 is adjusted to a selected position by sliding the carriage along the arm 102 until a selected transverse hole of the carriage is aligned in registration with a hole 116 in the arm. The archer then slides the carriage pin 118 through the aligned holes to maintain the carriage 114 in the selected position.

Turning now to the theory of operation of the trolley arm invention, in prior art bows, the limbs are balanced. That means that the tiller for each of the two limbs is the same. As stated above, the "tiller" of a bow is the distance from the point where the limb meets the riser to the bowstring along a line that is perpendicular to the bowstring when not pulled aft by the archer. Archers are taught to adjust the tension of adjustable limbs so that the tiller is the same distance for both limbs.

As best seen in FIGS. 15 and 16, with the bowstring 18 relaxed the bowstring 18 does not contact or does not apply a force against the pulley 110. In that state, the functional condition of the bow is as if the trolley arm were not present. However, with the use of the trolley arm of the invention near the outer end of the upper limb, when the bowstring is pulled aft, the bowstring comes into contact with the pulley of the trolley arm. As the bowstring is pulled further aft against the pulley, the upper end of the limb 12 becomes more inclined aft and closer to horizontal and the bowstring becomes bent around an indirect, non-linear and curved path from the upper cam 16 to the nocking point [not visible in FIGS. 14-18—the nocking point is the point at the center of the bowstring where the nock (rear end) of the arrow is seated]. When pulled to full draw as shown in FIGS. 17 and 18, the bowstring 18 curves forward from the upper cam 16 and then curves aft partially around the trolley arm pulley 110 and then to the nocking point. This indirect, curved path of the bowstring raises the nocking point above center and moves the upper part of the bowstring to a more forward position than it would have in the absence of the trolley arm. This indirect path has the effect of shortening the effective length of the bowstring by shortening the distance from the nocking point to the upper cam 16. The result is that, as the bowstring is pulled back, the nocking point moves slightly upward. As with the previously described draw weight adjuster when used with the previously described cam link length adjuster and release, the bowstring will be inclined slightly forward at its upper end with respect to its lower end. After the bowstring is released, as the bowstring moves forward, the bowstring at the nocking point will apply a slight downward component of force on the nock of the arrow and the nocking point has a gradual downward component of motion in addition to its forward component of motion. The downward components of force and motion on the nock of the arrow give the arrowhead an upward component of motion as it slides across the arrow shelf. That causes the arrow to rise as it is released from the bowstring. This has the same result as the above-described draw weight adjuster when used with the above described cam link length adjuster and release.

The arrow, when released, is therefore headed slightly upward; that is, it lofts. This feature allows the archer to sight directly along the arrow to the target with the bowstring and arrow pulled aft to full draw. With the bowstring and arrow pulled back, the archer sights along the arrow and directly at the target instead of sighting slightly above the target to compensate for the gravitational fall of the arrow as it travels along its trajectory toward the target. The loft that is caused by the trolley arm of the invention gives the arrow an initial trajectory above the path sighted by the archer in a direct straight line to the target. Therefore, it is the loft caused by the invention that compensates for the gravitational fall of the arrow along its trajectory. The archer can aim directly in a straight line to the point on the target where the archer wants the arrow to hit the target. The invention rather than the archer compensates for gravity.

The amount of loft is a function of the effective length of the trolley arm. That effective length is the distance from the limb to the forward surface of the trolley arm pulley that engages the bowstring. Consequently that distance is made adjustable by providing the ability to adjust the position of the pulley axle 112. The shorter the effective length of the arm 102, the greater the loft. For each particular individual bow, the archer will need to experiment by trying different pulley axle positions along the arm 102 and different target distances and then, for each shot, measuring the amount of gravitational compensation for each axle position. The archer then adjusts the pulley axle position for the distance the archer expects to encounter in the use of the bow.

It is desirable that the arm 102 is sufficiently flexible that, with the bowstring released, the pulley 110 can be manually pushed sideways away from the bowstring and then the arm 102 pivoted forward toward the limb 12. That permits the trolley arm to be easily deactivated and easily reactivated by the archer.

Experiments with an experimental prototype of the trolley arm has revealed that the force that must be applied to the bowstring to draw it to full draw is greater than the force required to draw it to full draw without the trolley arm. It is theorized that the reason is that the trolley arm is connected to the limb at a location that is spaced from the end of the limb closer to the riser. Therefore, the lever arm, from the butt of the limb (at the riser) to the location on the limb where the trolley arm applies its force to pull the limb aft, is shorter than the distance from that butt to the cam 16. Additionally or alternatively, the bowstring is effectively shorter as a result of its curved indirect path to the cam as described above. Consequently, the shorter lever arm or the effectively shorter bowstring or both cause a need to apply a greater force on the bowstring to draw it to full draw. This seems to further increase the energy stored in the limbs for propelling the arrow.

As a result of testing with the experimental prototype, I believe that the optimum distance from the outer end of the limb to the place of connection of the trolley arm to the limb is 1.5 inches. Of course some adjustment can be made from that location and it appears to me that distance should be in the range from 1.5 inches to 2.5 inches. Similarly, the preferred length of the trolley arm positions the forward peripheral surface of the pulley 110 about ⅛ (0.125) inch from the relaxed bowstring. Some adjustment of that distance can be made but preferably that distance should be in the range from 0 inches to ⅛ inch. Also, I believe that the optimal diameter of the pulley 110 is 1 inch and it should be in the range from 0.75 inch to 1.5 inches.

GUIDE TO REFERENCE NUMERALS

10 bow riser
11 hand grip
12 upper limb
13 arrow shelf
14 lower limb
16 cams or eccentric wheels
18 bowstring
20 toggle arm
22 toggle arm fulcrum
24 limb deflector
26 loading end segment of each limb
28 limb fulcrum
30 butt end of limb
32 limb rocker pivot channel
34 limb rocker pivot protrusion
36 limb pocket
38 limb pocket floor
40 limb pocket sidewall
42 cam cap

43 central end of cam cap
44 cam
46 fastener
48 expanded head of the fastener
49 retaining rings adjacent cam 44
50 cam extension lever 50U and 50L
52 cam link 52U and 52L
54 hand trigger or toggle arm
56 bend in hand trigger
58 hand trigger extension
60 cam follower
62 resilient elastic washer
64 longitudinally spaced holes along toggle arm and cam extension levers
66 mounting plate
68 outer end of the cam cap
70 cam link length adjuster and release
72 V shaped, spring steel clip of link adjuster
74 and 76 legs of link adjuster clip
78 tab of link adjuster clip
80 holes through legs of link adjuster clip
82 secondary wire of link adjuster clip
84 wire loop of link adjuster
100 trolley arm
102 arm of trolley arm
104 pivot axle of trolley arm
106 upper end of upper limb
108 pivot axle support bracket
110 pulley of trolley arm
112 pulley axle
114 trolley arm carriage
116 holes along arm
118 pin through trolley arm carriage This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A compound bow draw weight adjuster attached to a compound archery bow having a riser with a centrally positioned hand grip and a pair of limbs pivotally mounted to the riser and attached at their outer ends to a bowstring, each limb having a limb fulcrum about which the limbs pivot, the limbs having a loading end segment extending centrally from the limb fulcrum, the draw weight adjuster comprising:

(a) a toggle arm pivotally mounted to the riser at a toggle arm fulcrum;

(b) a limb deflector positioned on the riser at the loading end segment of each limb, each limb deflector comprising, (i) a cam cap spaced from the loading end segment of the limb;

(ii) a cam interposed between the cam cap and the loading end segment of the limb;

(iii) a fastener extending through the cam cap and through the loading end segment of the limb and anchored in the riser, the fastener having an expanded head preventing the cam cap from sliding off the fastener; and (iv) a cam extension lever fixed to the cam for rotating the cam;

(c) a first cam link connected between the toggle arm at one side of the toggle arm fulcrum and a first one of the cam extension levers for rotating its cam; and (d) a second cam link connected between the toggle arm at the opposite side of the toggle arm fulcrum and a second one of the cam extension levers for rotating its cam.

2. A compound bow draw weight adjuster in accordance with claim 1 wherein the toggle arm includes a hand trigger extending to a position spaced forward of the bow's hand grip by a distance that allows the archer, while holding the bow with the bowstring pulled back, to extend the archer's fingers forward and over the hand trigger in order to actuate the hand trigger by pulling it aft.

3. A compound bow draw weight adjuster in accordance with claim 2 wherein the hand trigger further comprises a trigger extension fixed to the hand trigger and extending forward of the hand trigger to provide a secondary hand trigger.

4. A compound bow draw weight adjuster in accordance with claim 2 and further comprising a cam follower interposed between each cam and the loading end segment of the limb, the fastener also extending through the cam follower.

5. A compound bow draw weight adjuster in accordance with claim 4 wherein the cam links are wires.

6. A compound bow draw weight adjuster in accordance with claim 5 wherein the fastener is a screw and the expanded head of the screw is a nut threadedly engaged to the screw for permitting rotation of the nut to adjustably select a minimum limb force applied to the bowstring.

7. A compound bow draw weight adjuster in accordance with claim 5 wherein a resilient elastic washer is interposed between the expanded head of the fastener and the cam cap.

8. A compound bow draw weight adjuster in accordance with claim 5 wherein the toggle arm and the levers have a series of longitudinally spaced holes for selective attachment of the links to permit adjustment of their lever arm lengths.

9. A compound bow draw weight adjuster in accordance with claim 5 wherein a mounting plate is fixed to the riser and the toggle arm is pivotally mounted to the mounting plate.

10. A compound bow draw weight adjuster in accordance with claim 5 wherein (a) the toggle arm is pivotally mounted to the riser with the toggle arm fulcrum above the hand grip of the bow riser;

(b) the first cam link is an upper cam link and is connected between a forward extending segment of the toggle arm and an upper cam extension lever; and (c) the second cam link is a lower cam link and is connected between an aft extending segment of the toggle arm and a lower cam extension lever.

11. A compound bow draw weight adjuster and release in accordance with claim 5 wherein (a) the toggle arm is pivotally mounted to the riser with the toggle arm fulcrum below the hand grip of the bow riser;

(b) the first cam link is an upper cam link and is connected between an aft extending segment of the toggle arm and an upper cam extension lever; and (c) the second cam link is a lower cam link and is connected between a forward extending segment of the toggle arm and a lower cam extension lever.

12. A compound bow draw weight adjuster in accordance with claim 5 and further comprising a cam link length adjuster and release connected to one of the cam links and the toggle arm.

13. A compound bow draw weight adjuster in accordance with claim 12 wherein at least one of the cam links includes a cam link length adjuster and release that comprises:

(a) a springy steel strip that is formed into a V-shaped clip having two spread apart legs, the clip having a protruding tab on one of its legs that engages the other leg and retains the legs together when the legs are pinched together and releases the other leg when the tab is deflected away from the other leg to allow return of the other leg to a spread apart configuration, the clip having a pair of close tolerance holes, one hole in each leg of the clip, the cam link extending through the holes, to a free end of the cam link; and (b) a secondary wire fixed to the clip and attached to the toggle arm.

14. A compound bow draw weight adjuster in accordance with claim 1 and further comprising a trolley arm mounted to an upper one of the limbs for lofting an arrow shot from the bow in a trajectory above a line of sight along the arrow to a target, the trolley arm comprising:

(a) a rotatable arm pivotally connected at a pivot axis to the upper limb at a position spaced from the upper end of the limb and rotatable to extend aft of the limb;

(b) a pulley having a pulley axle pivotally mounting the pulley to the rotatable arm at a position spaced from said pivot axis by a distance that permits the pulley to be positioned aft of the bowstring and an outer peripheral surface of the pulley to engage the bowstring when the bowstring is drawn.

15. A bow in accordance with claim 14 wherein the pulley axle is adjustably mountable at multiple positions along the rotatable arm to permit selective adjustment of the distance from the upper limb to the pulley axle.

16. A compound bow draw weight adjuster in accordance with claim 14 wherein the rotatable arm has a series of lengthwise spaced holes for selective attachment of the pulley axle.

17. A compound bow draw weight adjuster in accordance with claim 14 wherein the axle is mounted to a carriage that is slidable along the rotatable arm and attachable to the rotatable arm at multiple locations along the rotatable arm.

18. A compound bow draw weight adjuster in accordance with claim 17 wherein the rotatable arm has a series of lengthwise spaced holes and the carriage has a transverse hole with a pin that is slidable through the transverse hole in the carriage and through a selected hole in the rotatable arm for positioning the carriage at a selected one of multiple locations along the rotatable arm.

* * * * *